US007503274B2

(12) United States Patent
Weed et al.

(10) Patent No.: US 7,503,274 B2
(45) Date of Patent: Mar. 17, 2009

(54) FLOATING LIFT FOR WATERCRAFT

(75) Inventors: Ronald T. Weed, Arnold, MD (US); Richard W. Rapp, Morristown, NJ (US)

(73) Assignee: Ronald T. Weed, Jr., Arnold, MD (US)

( * ) Notice: Subject to any disclaimer, the term of this patent is extended or adjusted under 35 U.S.C. 154(b) by 18 days.

(21) Appl. No.: 11/746,744

(22) Filed: May 10, 2007

(65) Prior Publication Data

US 2008/0276851 A1 Nov. 13, 2008

(51) Int. Cl.
*B63C 1/02* (2006.01)

(52) U.S. Cl. ..... 114/45; 405/4

(58) Field of Classification Search ..... 114/44, 114/45, 48, 46, 47, 258, 259, 261, 262, 267; 405/1, 3, 4
See application file for complete search history.

(56) References Cited

U.S. PATENT DOCUMENTS 3,191,389 A * 6/1965 Poe ..... 405/3
3,362,172 A 1/1968 Rutter
3,603,276 A 9/1971 De Lisle
3,727,415 A 4/1973 Williams
3,734,046 A 5/1973 Schmidt
3,860,982 A 1/1975 Rumsey
3,895,592 A 7/1975 King
3,967,570 A 7/1976 Bradfield
4,018,179 A 4/1977 Rutter
4,037,421 A * 7/1977 Whitley, Jr. ..... 405/3
4,732,102 A 3/1988 Holman
4,955,308 A 9/1990 Craddock
5,090,841 A 2/1992 Penick, Jr.
5,131,342 A 7/1992 Sackett
5,380,143 A 1/1995 Mohan
5,390,616 A * 2/1995 Roth ..... 114/44
5,655,850 A 8/1997 Holmgren
5,664,513 A 9/1997 Echelbarger
5,826,528 A * 10/1998 Jancsek ..... 114/45
5,855,180 A 1/1999 Masters
5,931,113 A 8/1999 Eva
6,032,601 A 3/2000 Gates
6,257,159 B1 7/2001 Siegmann
6,547,485 B2 4/2003 Elson
6,575,661 B1 6/2003 Phillips
6,602,022 B1 * 8/2003 Wilkins ..... 405/3
6,823,809 B2 11/2004 Hey
6,964,239 B2 11/2005 Vinnik

* cited by examiner

*Primary Examiner*—Lars A Olson

(57) ABSTRACT

The mobile floating lift is disclosed and may include a cradle dimensioned and adjustable to conform to, engage, lift and store a watercraft, wherein the cradle has at least a first end and a second end opposite the first end, at least two floatation assemblies, each spaced along separate axes, each of the at least two floatation assemblies having at least one floatation device, wherein the cradle is spaced between the at least two floatation assemblies pivotally attached near the first end of the cradle at least one pivot point, and at least one drive mechanism operatively connected to at least one of the at least two floatation assemblies and to the cradle for moving the cradle in an arcing vertical direction toward the at least two floatation assemblies, wherein the at least one drive mechanism operates to raise the second end of the cradle in an arc relative to the pivot point.

16 Claims, 9 Drawing Sheets

FRONT VIEW

REAR VIEW

FRONT VIEW

REAR VIEW

FLOATING LIFT FOR WATERCRAFT

BACKGROUND OF THE INVENTION

1. Field of the Invention

The invention relates to the field of watercraft vessel lifts, and in particular, floating lifts for watercraft.

2. Introduction

From ancient times, sailors' concerns in regard to boat maintenance have included harmful effects associated with boats stored or moored floating and or immersed in water. Boats stored or moored while floating on their own hulls and or immersed in water are subject to damage not limited to water absorption in and through the hull, electrolysis and marine growth such as barnacles, muscles and algae.

In addition to water being a harsh environment for a watercraft, many bodies of water are also subject to severe tide changes and rocky bottom and shoreline contours. In addition to water being a harsh environment for a watercraft, many bodies of water and their surrounding shoreline are subject to severe tide variations, rocky bottom and shoreline contours and severe icing conditions which render permanent docking structures ineffective with a resulting shortage of means for mooring a watercraft.

Watercraft lifts were developed to lift a boat clear from the water when the watercraft is not in use. Generally, watercraft lifts are mechanisms boat owners can operate to lower and raise their watercraft without professional boat handling assistance or experience.

Prior art attempts deal with these problems and show varying boat lift mechanisms have been lacking in many areas. Several attempts include boat lifts utilizing variable buoyancy air chambers as lifting devices and support mechanisms as described in U.S. Pat. Nos. 4,018,179, 3,727,415 and 3,362,172. These mechanisms vary in design, however all share the common fatal flaw in if the air chamber does not sustain a seal, the air leaks, buoyancy is lost, the design fails and the watercraft lowers down into the water.

Another common disadvantage to the air chamber actuated lift is inherent instability during actuation. As water is purged from tank or conversely flooded into tank a high and low pressure differential is created; water and air shift sides causing an uneven weight distribution and instability which necessitates drawing stability from a non-inclusive third party structures such as docks, piers, seawalls and bulkheads.

Yet more prior art in the field of boat lift mechanisms show a number of designs like U.S. Pat. Nos. 3,967,570, and 3,727,415 whose fatal flaws include the requirement for attachment to and support from secondary structures, and objects such as fixed and floating docks, bulkheads and seawalls. Furthermore, these design lack an independently floating front pivot point, not allowing the pivot point to raise and lower, so as to not produce an asymmetrically forward cant, so as to not allow such a watercraft lift to more evenly engage a watercraft, be self sustainable, or operate in shallow water.

Other boat lift mechanisms prior art attempts, like U.S. Pat. No. 6,575,661, include boat lift mechanisms mounted to stationary objects such as the seafloor, a bulkhead and a stationary non floating pier or dock, for example. In all these cases a fatal flaw exists in a limitation of lifting height versus differing extreme tidal fluctuations and flooding. When the tidal fluctuation height surpasses this type of boat lift mechanisms maximum lifting height the boat could float off. This type of lift is also limited in its transportability and transferability and often requires substantial alteration to or addition of aforementioned third party support structures.

Yet more prior art in the field of boat lift mechanisms shows a number of designs like U.S. Pat. Nos. 6,964,239B2, 6,032,601, and 6,823,809 wherein fixed floatation devices are moved and manipulated to lift both the boat and the boat lift mechanisms. These boat lift mechanisms vary in design and complexity but share common traits and undesirable flaws and limitations such as their submerging of substantial moving parts of the boat lift including drive and winding mechanisms respectively.

For example, U.S. Pat. No. 6,964,239B2 is shown with a substantial amount of "base structure" "comprising: at least one parallelogram linkage supporting a cradle of boat bunks, requiring that at least one parallelogram linkage and at least one aqueous hydraulic cylinder are always underwater. This mandatory submerging and actuation during submersion of substantial moving parts and drives directly effect and degrade the boat lift mechanism in a manner similar to the way in which immersed watercraft are affected and degraded. Additional shortcomings relative to these designs include the number and complexity of moving parts and their limitations on boat sizes, hull shapes and configurations. For example, a deep draft boat or sailboat having a deep draft keel cannot enter exit, or be lifted by, this design.

Yet more prior art in the field of boat lift mechanisms attempt to combine multiple, connected, hollow, airtight floatation units to form a floatation surface, examples of which are U.S. Pat. Nos. 5,855,180 and 5,931,113. These designs require a watercraft to propel itself up and onto the floatation surface and to be pulled off of the floatation surface for launching, precluding usage of the design by watercraft having insufficient thrust and/or deep drafts such as sailboats.

There remains a need in the art for a boat lift mechanism that will lift and sustain a watercraft above the water, that floats and is self sustaining, that does not require support or stability from fixed structures, that is unaffected by fluctuation in water levels, that limits the submerging of substantial moving parts including drive and winding mechanisms, that accepts a variety of watercraft including deep draft vessels, and that eliminates the potential of air leakage associated with air chambers and associated valves, pumps and plumbing.

SUMMARY OF THE INVENTION

The mobile floating lift is disclosed and may include a cradle dimensioned and adjustable to conform to, engage, lift and store a watercraft, wherein the cradle has at least a first end and a second end opposite the first end, and may include at least two floatation assemblies, each spaced along separate axes, each of the at least two floatation assemblies having at least one floatation device, wherein the cradle is spaced between the at least two floatation assemblies pivotally attached at least near the first end of the cradle at at least one pivot point, and at least one drive mechanism operatively connected to at least one of the at least two floatation assemblies and to the cradle for moving the cradle in an arcing vertical direction toward the at least two floatation assemblies, wherein the at least one drive mechanism operates to raise the second end of the cradle in an arc relative to the pivot point.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

The invention comprises a variety of embodiments, such as an apparatus and other embodiments that relate to the basic concepts of the invention.

The invention relates to mobile floating lifts that are capable of raising a floating watercraft out of the water, storing it above the water, and lowering it into the water. Details of possible embodiments of the invention are presented in the following description and in FIGS. 1, 2, 3, 4, 5A, 5B, 6A, 6B, 7A, 7B, 8, 9A and 9B, generally identified with the numeral 100; however, other embodiments of the invention may be employed with numerous details that differ from those relating to the possible embodiment described below.

It is further understood that the term "watercraft" relative to the following description may include but is not limited to, boats, personal watercraft, submersibles, hovercraft, amphibious vehicles, aircraft and other vessels, equipment or devices having the ability to float, for example. FIGS. 1, 2, 4, 5A, 5B, 6A, 6B, 7A, and 8 show a watercraft for referencing purposes, generally identified with the numeral 200

Figure 1:
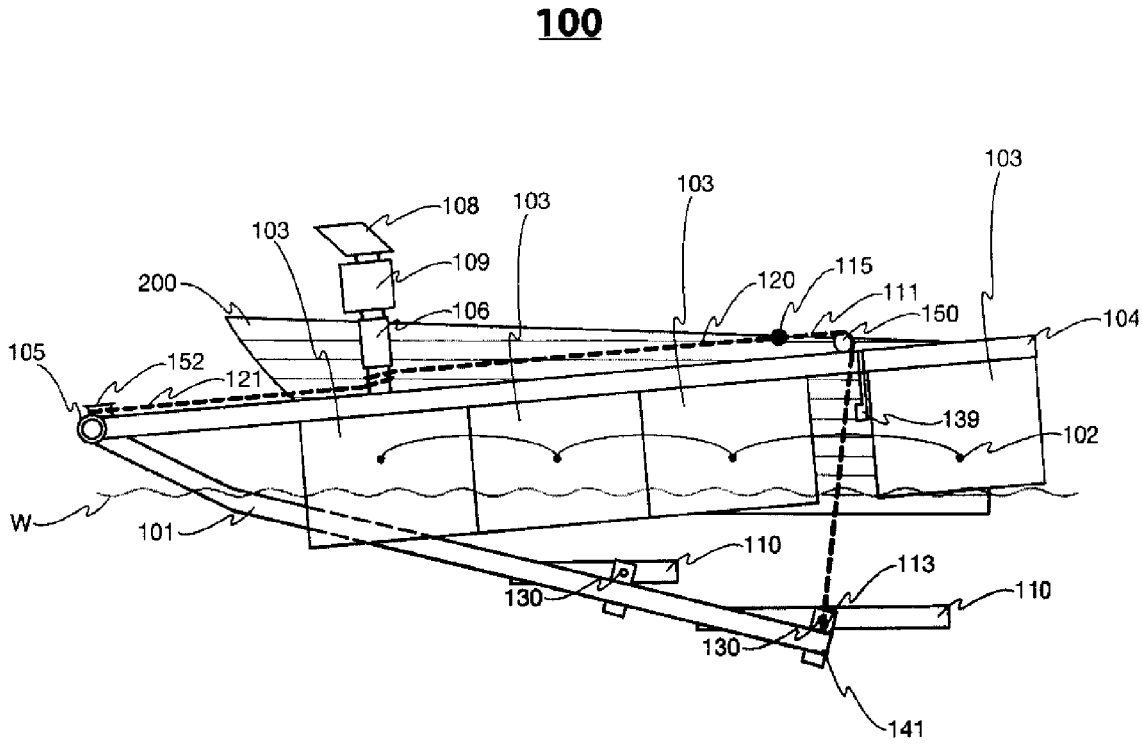
FIG. 1 is an elevation view of the side of an exemplary watercraft lift in its lowered position in accordance with a possible embodiment of the invention.

FIG. 1 is an elevation view of an exemplary watercraft lift 100 in its lowered position according to a possible embodiment of the invention with the left end shown as its forward end, and the right end shown as its rearward end. The watercraft lift 100 may include a cradle 101 for supporting, lowering and lifting of a watercraft.

Cradle 101 may include bunks 110 that engage and support a watercraft 200, the bunks may be oriented at least longitudinally (as shown in FIGS. 1, 2, 3, 4, 5A, 5B, 6A, 6B, 7A, 7B, 8, 9A and 9B), laterally, or in any orientation that will perform the function of engaging and supporting a watercraft. The bunks 110 may be at least pivotally connected to cradle 101 at least points 130 for conforming to and engaging a watercraft hull. Cradle 101 may be spaced between at least the supporting at least two floatation assemblies 102, which may be at least substantially longitudinal (shown in FIG. 1, for example).

Each floatation assembly 102 may include at least one floatation unit 103 which may be secured-by at least structural support member 104. The floatation units 103 may be constructed with at least, but not limited to, plastic and metals and may be at least treated with, infused with and constructed with water resistant, corrosion resistant materials. Additionally the floatation units 103 may be hollow and may be sealed; the interior volume may be at least partially filled with at least buoyant material such as foam. Structural support members 104 may include attachment points (shown in FIG. 1, for example) for at least the floatation units 103, winch drive mechanism 106, battery 109 and solar charger 108, pulleys 150-155, locking mechanism 139-140. Furthermore, for example, in another of the many possible ways known to one of skill in the art, at least cradle 101 may also include attachment points for at least but not limited to the floatation units 103, the at least winch drive mechanism 106, battery 109 and solar charger 108, pulleys, and at least locking mechanisms 139 and 140.

The combined buoyancy provided by the at least two floatation assemblies 102 may exceed the combined above-water weight of a watercraft 200 and watercraft lift 100 so as to support an engaged watercraft 200 above the water. Cradle 101 may be pivotally attached at least near its forward end to at least the corresponding forward ends of the at least two floatation assemblies 102 at least a common, forward, pivot point 105 (shown in FIG. 4, for example) that may be connected to at least the cradle 101 and may be connected to at least the structural support members 104. The rearward non-pivotally connected end of cradle 101 and corresponding rearward ends of the at least two floatation assemblies 102 may be operatively connected by at least cordage bridal assemblies 111 and 112 (shown in FIG. 4, for example).

Still referring to FIG. 1 with watercraft lift 100 in this lowered position, disengaged and unburdened from a watercraft 200, the pivotally connected forward end may float as shown lower to the waterline 300, or water surface than is its operatively connected, rearward end. This biased floating characteristic of watercraft lift 100 may be substantially caused by at least the shown increased concentration of the at least two floatation assemblies 102 near the operatively connected rearward end of the watercraft lift.

Additionally, at least the longitudinal floating bias of lift 100 may be manipulated and changed by at least mounting the at least one floatation device 103 and the at least two floatation assemblies 102 to at least the structural support members 104 in different concentrations and locations along at least the lift's 100 longitudinal axis. Furthermore, for example, in yet another possible embodiment of the present invention, at least one floatation unit 103 may be attached to at least cradle 101 to at least further manipulatively balance the floating bias of the lift 100. This ability to change a lift's 100 longitudinal floating bias enables the lift 100 to at least properly support, balance and at least adjust to watercraft of differing weights, weight distributions and sizes. A concentration of the at least one floatation device 103 and floatation units 102 may therefore be at least biased along the watercraft lift's 100 longitudinal and lateral axis to at least substantially match with and at least counteract a particular watercraft's 200 longitudinally biased concentration of weight.

This floatation or buoyancy bias, as shown in FIG. 1 with lift 100 in its lowered, pivot down position, also at least lowers the forward, pivotal end of cradle 101, at least substantially reducing the amount by which it needs to pivot beneath the waterline 300 as to at least gain sufficient clearance between the bunks 110 and a watercraft 200 to be engaged and then lifted. This resulting reduction in at least the depth to which the rearward end of cradle 101 needs to pivot to at least allow a floating watercraft 200 to at least maneuver above submerged bunks 110 and thusly above cradle 101 to at least a position for engagement by watercraft lift 100, is at least substantially minimized, as are the length of cordage to be winched, the energy required to winch the cordage, and the time required to execute a complete pivot-up or pivot down cycle, by corresponding amounts.

Still referring to FIG. 1, drive mechanism 106, battery 109 and a battery solar charger 108 may be mounted to either, both and in any combination to at least cradle 101 and structural member 104 (shown in FIG. 1, for example), above the water or waterline 300.

Figure 2:
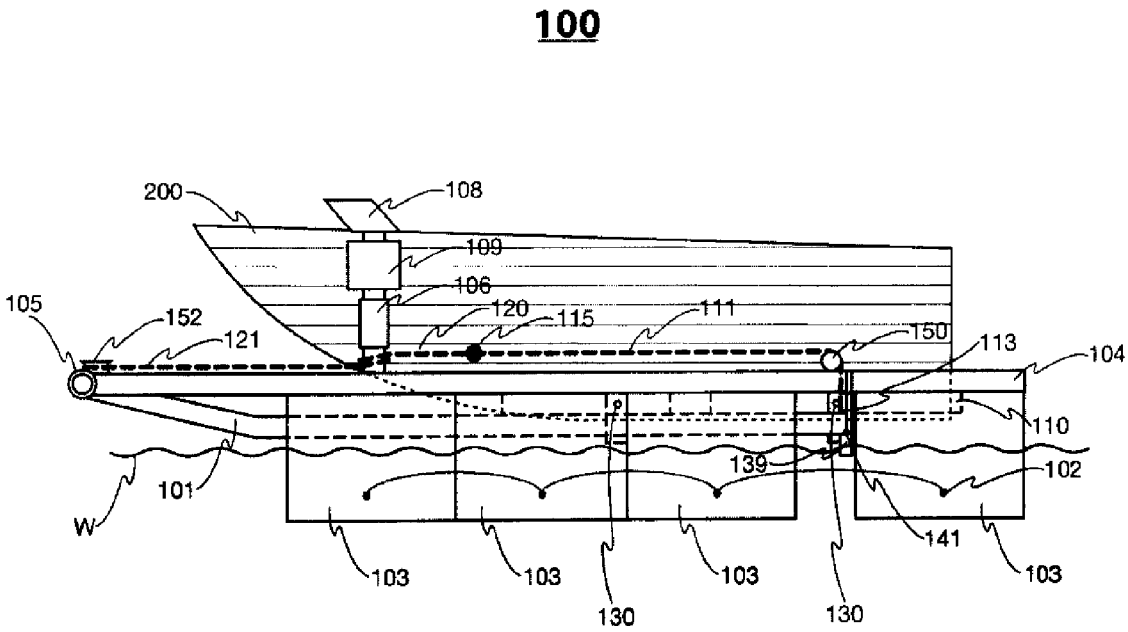
FIG. 2 is an elevation view of the side of an exemplary watercraft lift in its raised position, supporting a watercraft in accordance with a possible embodiment of the invention.

FIG. 2 is an elevation view of an exemplary watercraft lift 100 in its raised position with the left, pivotally connected end, shown as its forward end, and the right, operatively connected end, shown as its rearward end. In this raised position watercraft lift 100 is shown engaged with, and supporting, a watercraft 200 above the water 300 surface. Locking mechanism 139 and 140 (shown in FIG. 4, for example) may be hingedely attached to at least structural support members 104, and at least locking points 141 and 142 (shown in FIG. 4, for example) may be at least mounted to cradle 101. Locking mechanism 139 and 140 and locking point 141 and 142 may be aligned for at least lockably capturing one another (shown in FIG. 2, for example, in the raised position,) thusly locking the at least two floatation assemblies 102 and cradle 101 together, at least preventing the cradle 101 from inadvertently pivoting and lowering and or raising a watercraft 200.

Still referring to FIG. 2 with watercraft lift 100 in this raised position, engaged and supporting a watercraft 200 above the water, the pivotally connected forward end and the operatively connected, rearward ends are shown floating substantially equal in distance to, and substantially level with, the waterline 300. This unbiased, substantially level floating characteristic of watercraft lift 100 is substantially caused by at least the concentration of the at least two floatation assemblies 102 nearer the operatively connected rearward end of the watercraft lift at least counterbalanced by the above-water weight of a watercraft 200. In at least its fully raised position, as shown in FIG. 2, cradle 101 may be captured by locking mechanism 139 (and 140 not shown) using at least locking point 141 (and 142 not shown) rendering watercraft lift 100 and watercraft lift locked in an above the water fully raised position.

Figure 3:
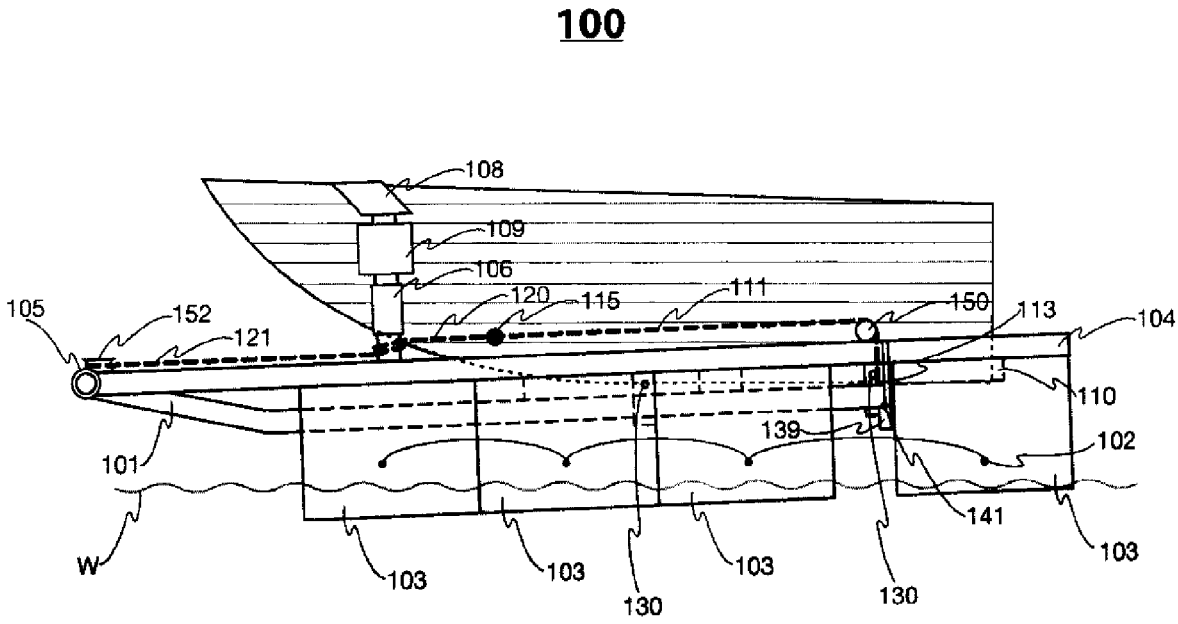
FIG. 3 is an elevation view of the side of an exemplary watercraft lift in its raised position in accordance with a possible embodiment of the invention.

FIG. 3 is an elevation view of an exemplary watercraft lift 100 in its raised position with the left, pivotally connected end, shown as its forward end, and the right, operatively connected end, shown as its rearward end. Watercraft lift 100 in this raised position, disengaged and unburdened from a watercraft 200, may float with its pivotally connected forward end lower to the waterline 300, or water surface than is its operatively connected, rearward end. This biased floating characteristic of watercraft lift 100 is substantially caused by at least the shown concentration of the at least two floatation assemblies 102 nearer the operatively connected rearward end of the watercraft lift 100.

Figure 4:
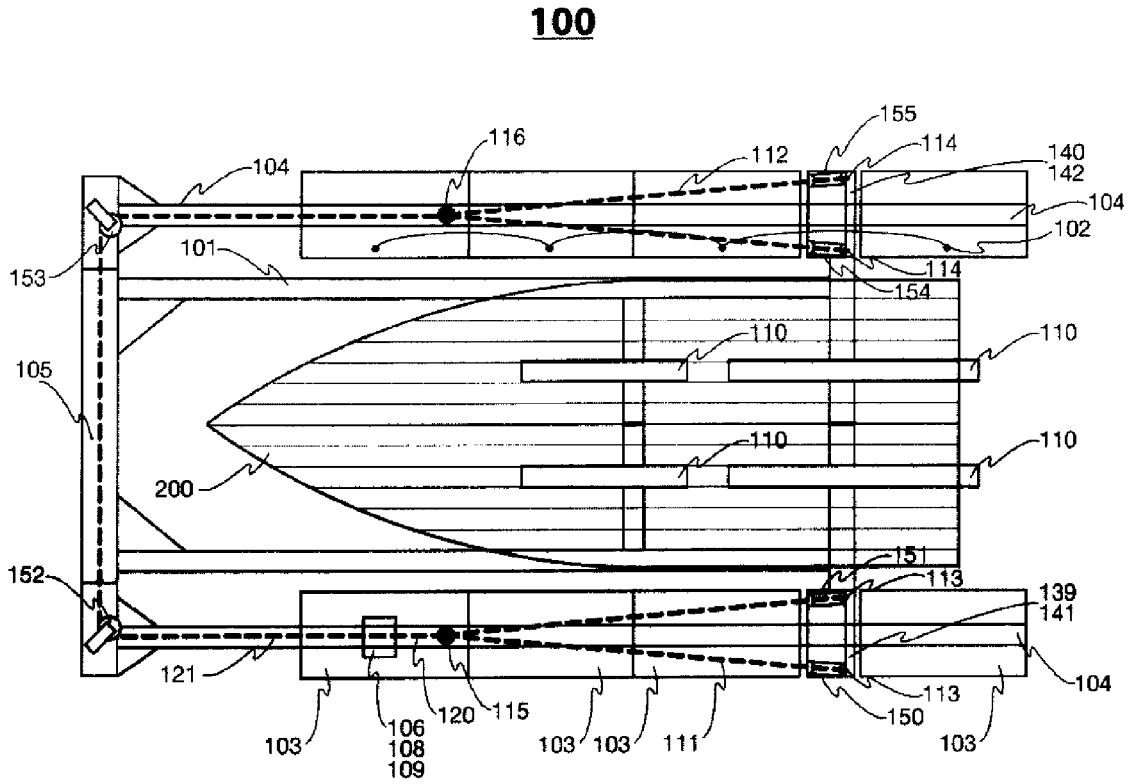
FIG. 4 is another plan view of an exemplary watercraft lift in it raised position in accordance with a possible embodiment of the invention.

FIG. 4 is a plan view of an exemplary watercraft lift 100 in its raised position according to a possible embodiment of the invention with the left end shown as its forward end, and its right end shown as its rearward end. In this raised position watercraft lift 100 is shown engaged with a watercraft 200. The forward end of cradle 101 and forward ends of the at least two floatation assemblies 102 may be connected by at least a pivot point 105 at least near the forward ends of structural support members 104. The rearward portions of cradle 101 and rearward portions of the at least two floatation assemblies 102 may be operatively connected by at least cordage bridal assemblies 111 and 112. Alternatively, for example, in another of the many possible ways known to one of skill in the art, at least one, and any combination of drive mechanisms including but not limited to hydraulics, and hydraulic ram cylinders, pneumatics, and pneumatic ram cylinders, chain, screws, gears or other means may connect to at least a portion of the cradle 101 and to at least a portion of the at least two floatation assemblies 102 for at least driving the lift 100 through its lift cycle. Cordage bridal assembly 111 may have at least two ends which may be attached to at least cradle 101 at least attachment points 113 and may be being routed through respective pulleys 150 and 151 and may be thusly over the at least two floatation assemblies 102. Cordage 120 may be connected using at least one of its ends to cordage bridal assembly 111 at cordage connection point 115, and may be spooled at least its opposite end to at least on the winch drive mechanism 106 which may contain a sufficient length of cordage 120 for at least pivoting down and pivoting up of cradle 101 through its designed range of motion, for example.

Cordage bridal assembly 112, may have each of its ends attached to cradle 101 at at least attachment points 114, and may be routed through at least respective pulleys 154 and 155 and thusly may be over the at least two floatation assemblies 102. Cordage 121 may be connected using at least one of its ends to at least cordage bridal assembly 112 using at least cordage connection point 116, it may be routed through at least pulleys 153 and 152 and, at its opposite end, it may be spooled onto at least a winch drive mechanism 106 which may contain at least a sufficient length of cordage 121 for at least pivoting down and pivoting up of cradle 101 through its range of motion (or pivot cycle). The lengths of cordage bridal assemblies 111 and 112 may be at least equal, with the desired effect of at least pivoting up and pivoting down of cradle 101 by at least substantially equal amounts relative to the at least two floatation assemblies 102 from which it is at least suspended, promoting at least substantially balanced raising and lowering of watercraft 200 relative to its lateral axis. Cordage bridal assemblies 111 and 112, by virtue of their adjustable lengths, may also enable the range of motion of the pivoting cradle 101 to be adjusted to at least accommodate the drafts of various watercrafts 200.

Figure 5A:
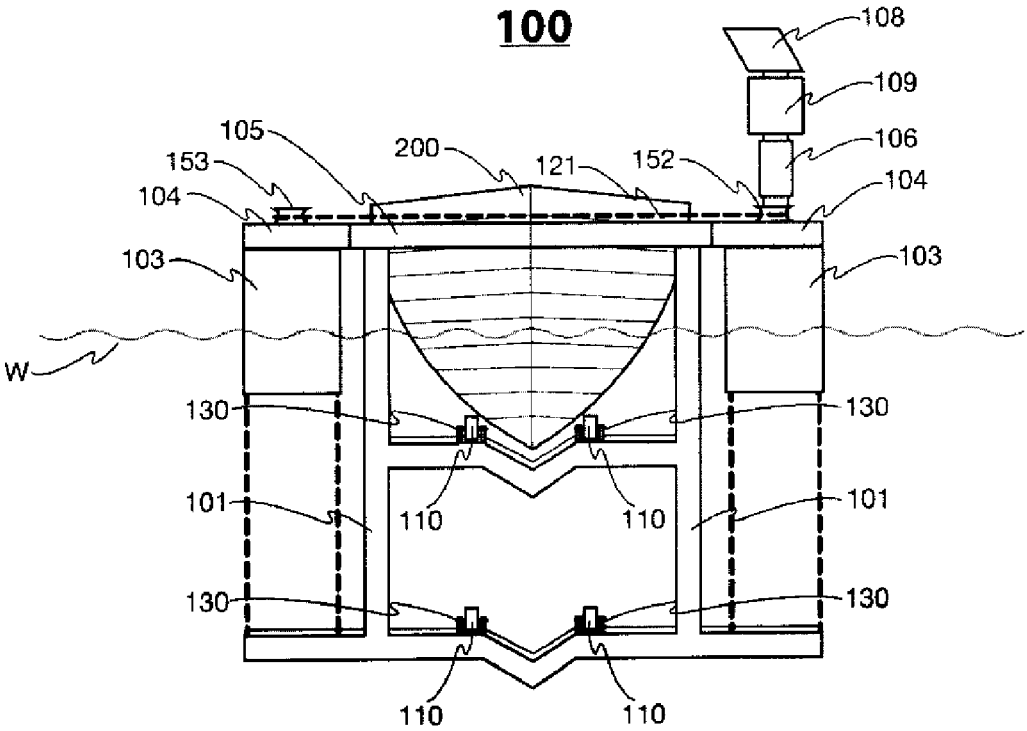
FIG. 5A is a front view of an exemplary watercraft lift in it lowered position in accordance with a possible embodiment of the invention.
Figure 5B:
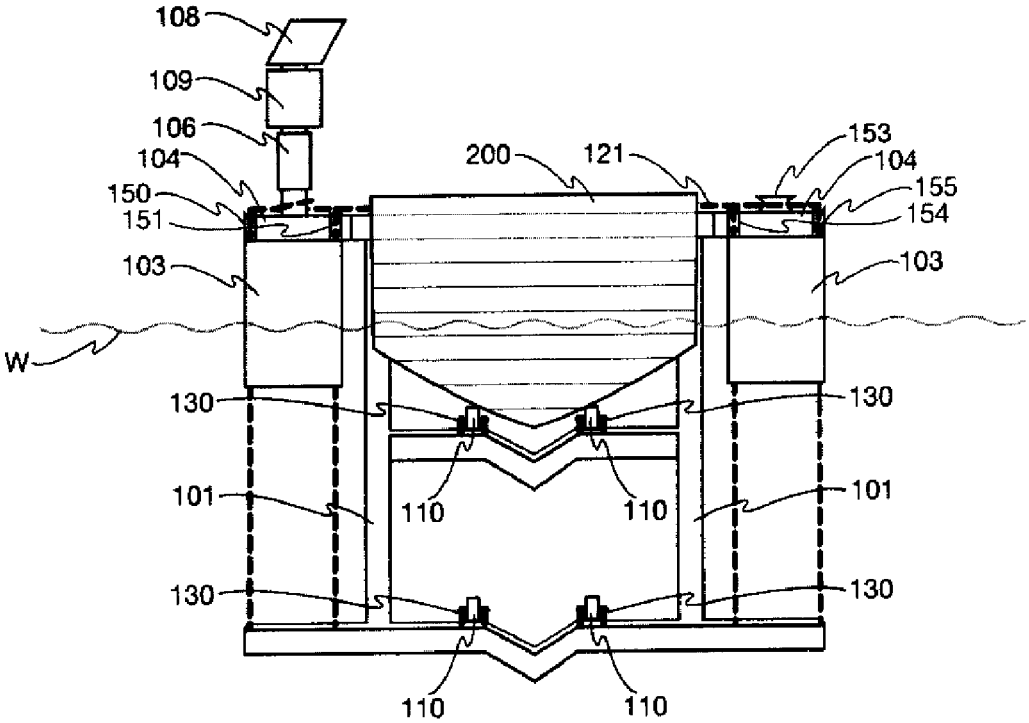
FIG. 5B is a rear view of an exemplary watercraft lift in it lowered position in accordance with a possible embodiment of the invention.

FIGS. 5A and 5B illustrate a front (FIG. 5A) view and a rear (FIG. 5B) view of an exemplary watercraft lift 100 in its lowered position. The lift 100, in this lowered position is shown with a watercraft 200 maneuvered between the at least two floatation assemblies 102 to a position for engagement with cradle 101 and thusly watercraft lift 100.

Figure 6A:
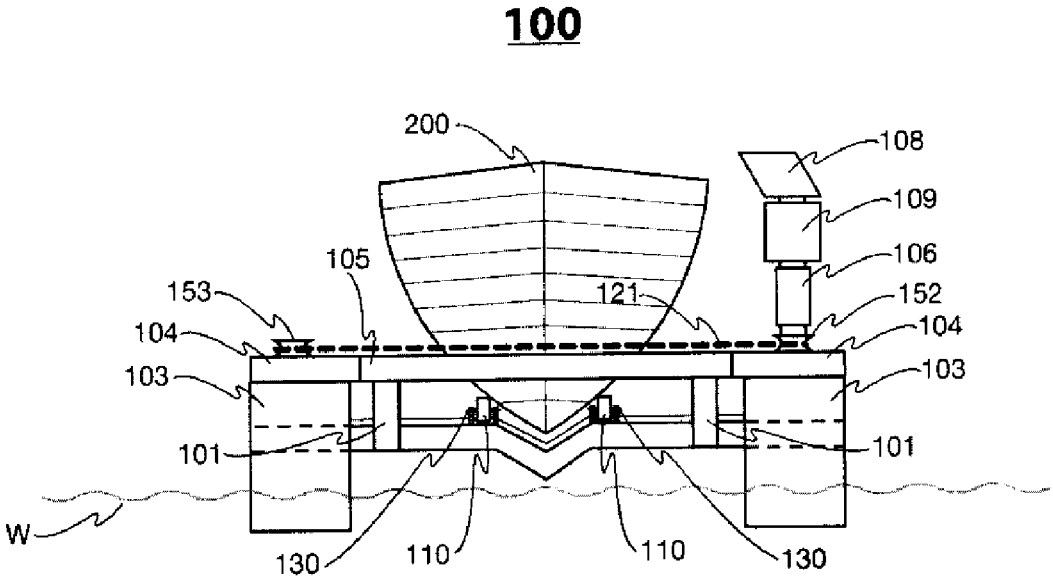
FIG. 6A is a front view of an exemplary watercraft lift in it raised position in accordance with a possible embodiment of the invention.
Figure 6B:
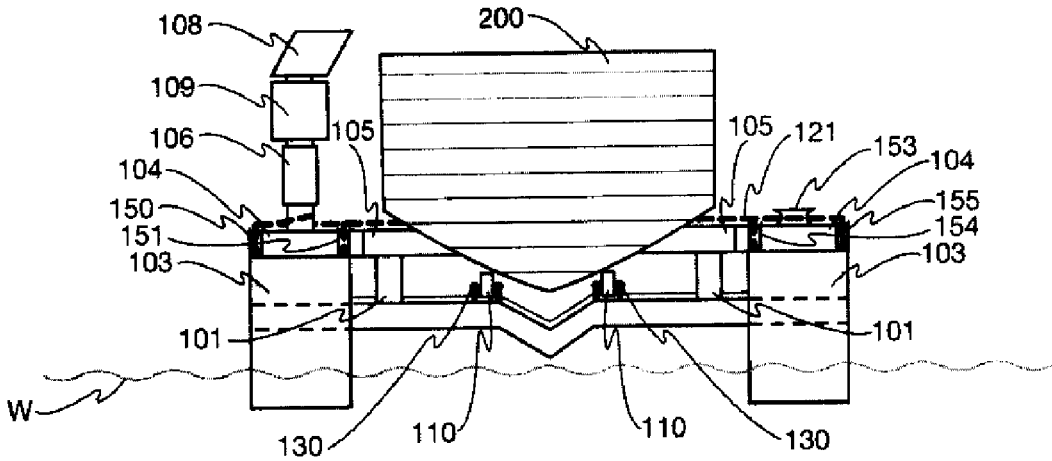
FIG. 6B is a rear view of an exemplary watercraft lift in it raised position in accordance with a possible embodiment of the invention.

FIGS. 6A and 6B illustrate an exemplary front (FIG. 6A) view and rear (FIG. 6B) view of an exemplary watercraft lift 100 in its raised position. Watercraft lift 100, in this raised position, is shown engaged with, and supporting, a watercraft 200 above the water 300 surface.

Figure 7A:
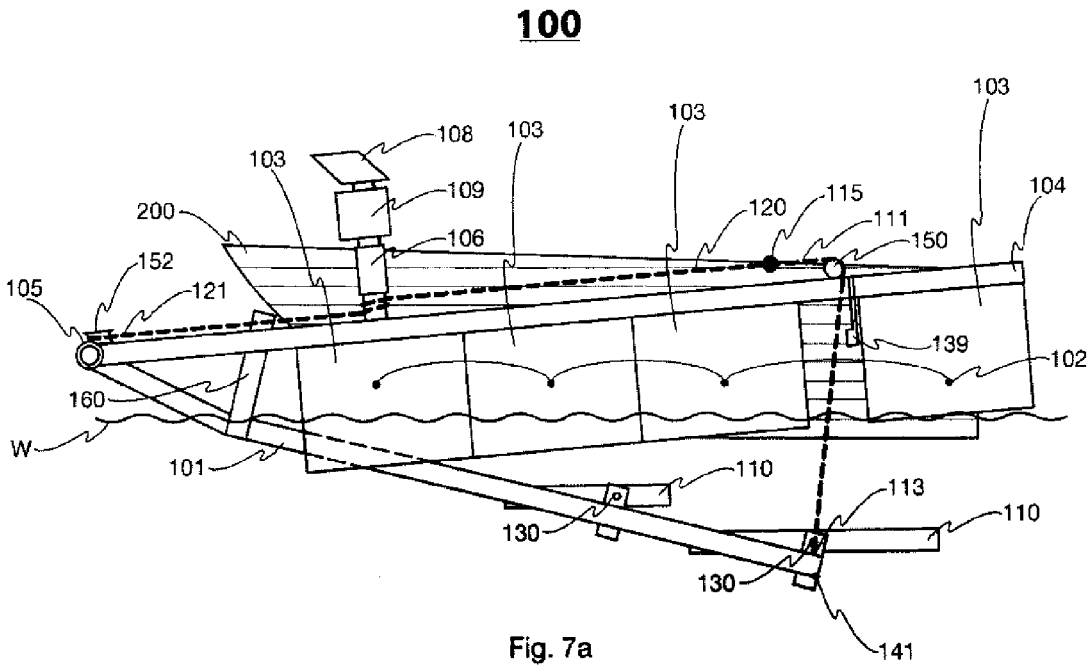
FIG. 7A is another elevation view of an exemplary watercraft lift in its lowered position in accordance with a possible embodiment of the invention.
Figure 7B:
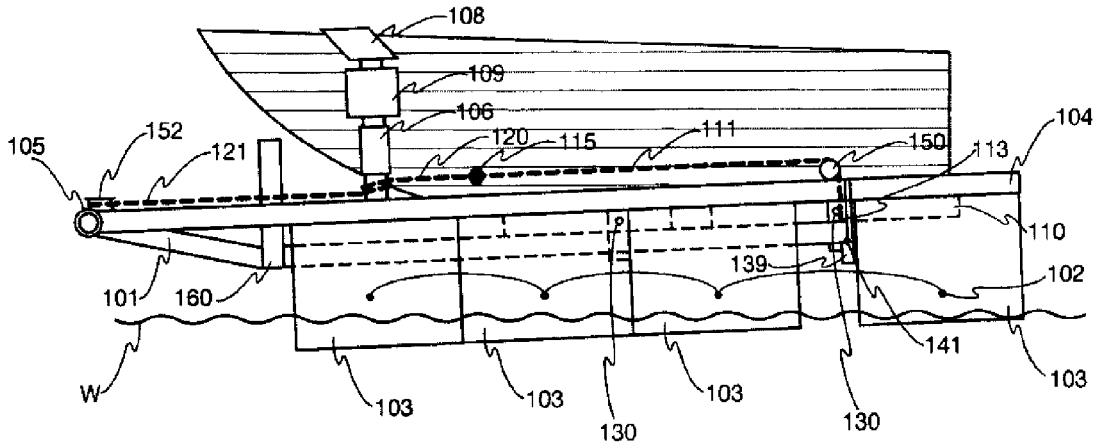
FIG. 7B is another elevation view of an exemplary watercraft in its raised position in accordance with a possible embodiment of the invention.

Now referring to FIGS. 7A and 7B an elevation view of watercraft lift 100 showing another possible embodiment of the invention. The cradle 101 may include, and is shown with, at least one vertical member piece 160 extending substantially perpendicular to the longitudinal axis of the cradle 101 for loose engagement with at least one member guide 161 spaced on at least one floatation assembly.

In the interest of brevity it should be understood that this second embodiment functions in the same manner as the previously described possible embodiment, and the addition of the vertical member piece 160 and the member guide 161 offers another solution to physical stability. As the floating lift 100 pivots through a cycle from a fully lowered position, shown by FIG. 7A, to a fully raised position, shown by FIG. 7B, and back from fully raised to fully lowered, the vertical member piece 160 remains loosely engaged with the member guide 161. The engagement of the vertical member piece 160 and the member guide 161 at least contributes to maintaining a general alignment between the lateral axes's of the cradle 101 and the at least two floatation assemblies 102.

Figure 8:
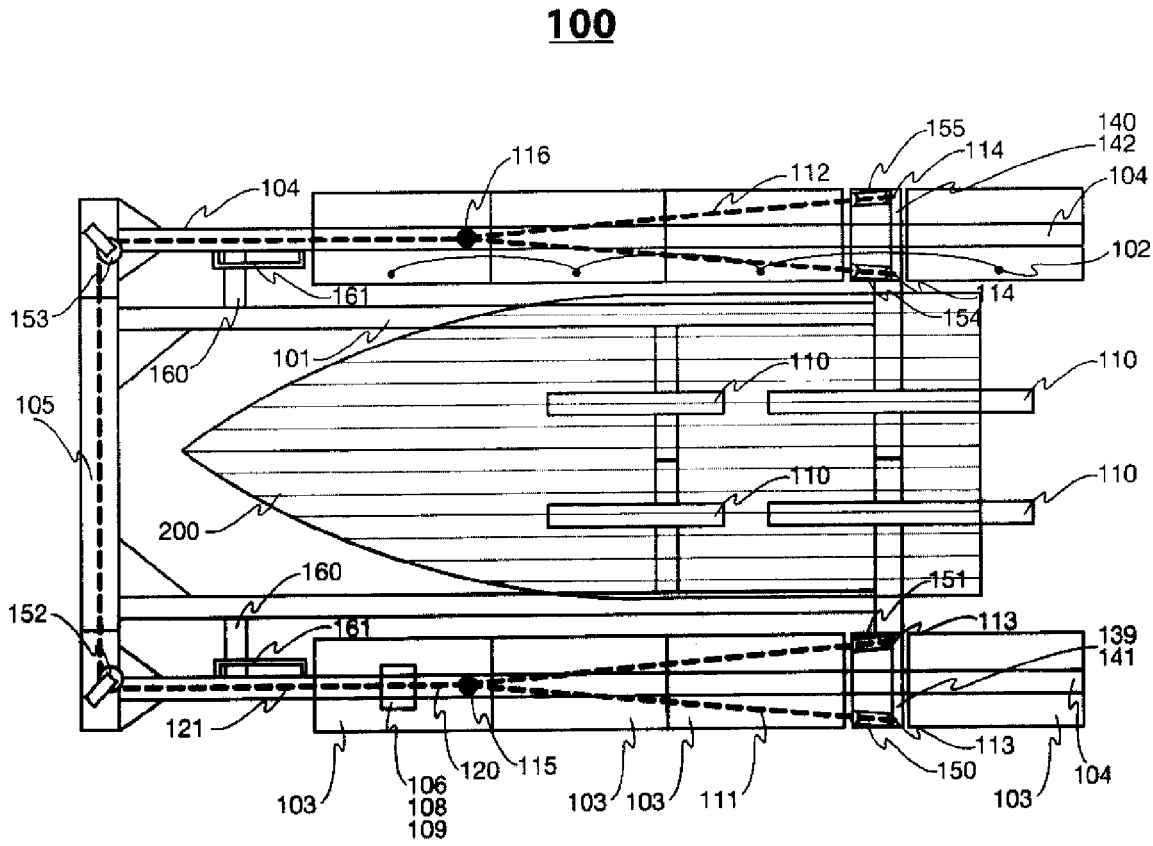
FIG. 8 is another plan view of an exemplary watercraft lift in its raised position in accordance with a possible embodiment of the invention.

FIG. 8 is a plan view of the exemplary, second embodiment of watercraft lift 100 shown also in FIGS. 7A and 7B.

Figure 9A:
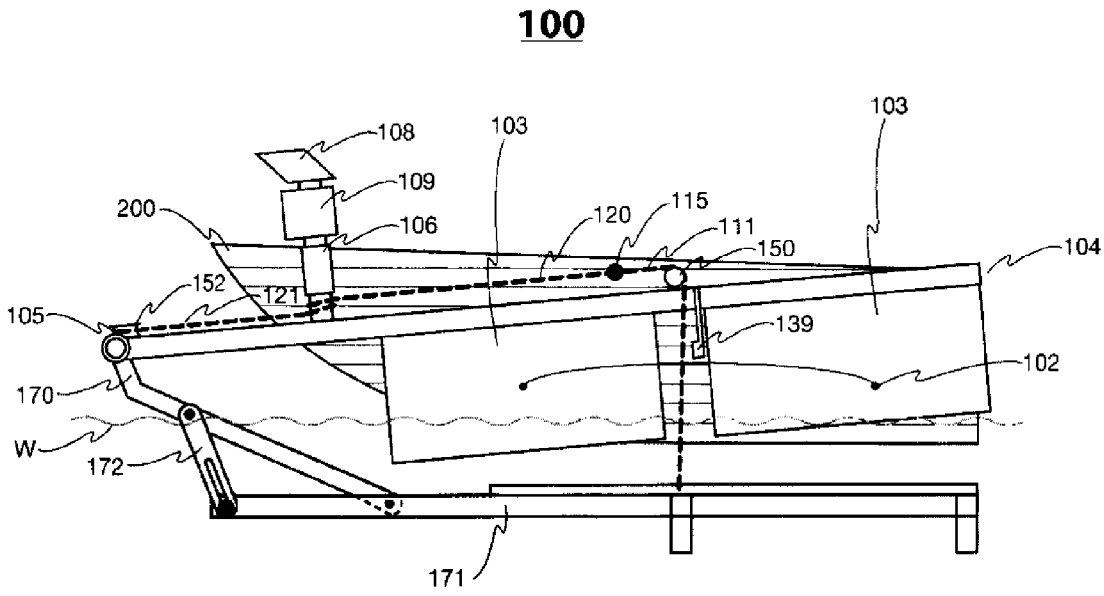
FIG. 9A is another elevation view of an exemplary watercraft in its lowered position in accordance with a possible embodiment of the invention.
Figure 9B:
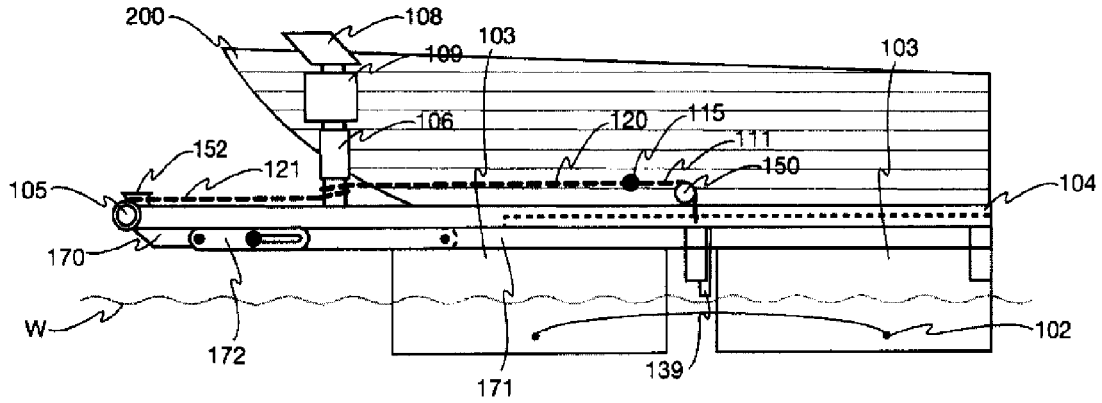
FIG. 9B is another elevation view of an exemplary watercraft in its raised position in accordance with a possible embodiment of the invention.

FIGS. 9A and 9B are elevation views of watercraft lift 100 with the left, pivotally connected end, shown as its forward end, and the right, operatively connected end, shown as its rearward end, showing yet another possible embodiment of the invention. The cradle may be comprised by at least two, as shown in FIG. 9, frame segments 170 and 171, each segment (170 and 171) having a first end and a second end opposite the first end. Each frame segment (170 and 171), at least near its end, may be at least hingeably joinable to at least additional frame segments. Additionally, the cradle frame segments 170 and 171 may attach to at least one cradle frame segment guide piece 172 for at least providing physical stability to at least the cradle and for at least limiting the range of pivot between at least each frame segment (170 and 171). In the interest of brevity it should be understood that this second embodiment functions in the same manner as the previously described possible embodiments, and the addition of the at least two, hingebly joinable cradle segments 170 and 171 offers another solution by reducing the lifts 100 draft requirements and total range of pivot cycle. As the floating lift 100 pivots through a cycle from a fully lowered position, shown by FIG. 9A, to a fully raised position, shown by FIG. 9B, and back from fully raised to fully lowered, at least the rearward end of cradle segment 170 and forward end of cradle segment 171 may pivot relative to one another at least reducing the depth required by the watercraft lift 100 to lower the rearward cradle segment 171 beneath the water 300 to a depth sufficient for a watercraft to be maneuvered to a position of engagement with the lift 100.

In operation, watercraft lift 100 may be located in a variety of water types and water salinity levels, and may be moored or anchored away from land or support structures, as this present invention may be self sustainable and stable. As generally exemplified in FIGS. 1, 2, 3, 4, 5A, 5B, 6A, 6B, 7A, 7B, 8, 9A and 9B, the lift 100 may pivot through a cycle from a fully lowered position, shown by FIGS. 1, 5A, 5B, and 7A, 9A, to a fully raised position as shown by FIGS. 2, 3, 4, 6A, 6B, 7B, 8, and 9B.

As previously described, a shift in the longitudinal floating characteristic of lift may 100 occur throughout this pivot cycle as the lift 100 pivots its cradle 101. During the pivoting cycle, the buoyancy force of the at least two floatation assemblies 102 increases as the depth to which they are submerged increases in relation to waterline 300, and the buoyancy force of the at least two floatation assemblies 102 decreases as the depth to which they are submerged decreases in relation to waterline 300.

The depth to which the at least two floatation assemblies 102 become submerged at least substantially determines the weight of water displaced by the submersion, which substantially equals the above-water weight of a watercraft 200 plus the above-water-weight of the watercraft lift 100, at any given point during the lifting cycle. Once a watercraft 200 and the cradle 101 are raised above the water level, or waterline 300, as shown in FIGS. 2, 6A, 6B, and 8, no substantial submersion of the at least two floatation assemblies 102 occurs other than that resulting shifts due to wind, waves, and/or the weight and movement of any individuals or gear subsequently added to or removed from a watercraft 200 and/or the watercraft lift. Provision for such variations in the combined weight and weight bias generally along a watercrafts longitudinal axis) of a watercraft 200 and watercraft lift 100 may be provided by equipping watercraft lift 100 with at least a combination of the at least one buoyancy device 103 forming the at least two floatation assemblies 102 that offer reserve buoyancy at least in excess of that required for each application.

As shown in FIGS. 1, 5A, 5B, 7A and 9A, watercraft lift 100 is in its lowered position. A watercraft 200 may be maneuvered between the at least two floatation assemblies 102 and thusly above cradle 101 to a position for being engaged by watercraft lift 100. To pivot cradle 101 upwardly from its lowered position shown in FIGS. 1, 5A, 5B, 7A and 9A, to its raised position shown in FIGS. 2, 3, 4, 6A, 6B, and 9B, winch drive mechanism 106 may be actuated to at least spool-in cordage 120 and 121.

The winch drive mechanism 106 is shown in this possible embodiment, however, alternatively, for example, in another of the many possible ways known to one of skill in the art, other mechanical means powered or manual), as well as hydraulic, pneumatic and other means, may be employed to cause cradle 101 to pivot upward and downward relative to the at least two floatation assemblies 102. As winch drive 106 at least spools-in cordage 120 and 121, at least the opposing ends of cordage 120 and 121, which may be connected to at least cordage bridal assemblies 111 and 112 using at least cordage connection points 115 and 116, may in turn be connected to attachment points 113 and 114, exert at least substantially upward tension on cradle 101 as the cordage 120 and 121 is routed through at least pulleys 150 and 151, and 154 and 151 respectively, causing cradle 101 to pivot upwards toward the at least two floatation assemblies 102, such that the substantially vertical arc between the at least pivotally connected cradle 101 and the at least two floatation assemblies 102 lessens until cradle 101 and the at least two floatation assemblies 102 are substantially parallel, at which point cradle 101 may have completed its pivot-up cycle and a supported watercraft 200 may have been raised clear above the water 300.

In disengaging a watercraft 200 from floating lift 100, in its raised position as shown in FIGS. 2, 3, 4, 6A, 6B, 7B, 8 and 9B, cradle 101 may be pivoted down to a lowered position as shown in FIGS. 1, 5A, 5B, 7A and 9A. With the lift 100 in its raised position as shown in FIGS. 2, 3, 4, 6A, 6B, 7B, 8 and 9B, locking mechanism 140 may be disengaged, then at least a winch drive mechanism 106 may be actuated for at least directionally un-spooling of at least cordage 120 and 121, which may allow bridal assemblies 111 and 112 to travel by substantially corresponding amounts through at least pulleys 150-151, 154-155, which in turn may allow cradle 101 to at least pivot down by a substantially corresponding amount.

As bridal assemblies 111 and 112 may be eased in the direction substantially away from the spooled cordage, the combined above water weight of cradle 101 and watercraft 200 and the buoyancy of floatation units 102 may allow cradle 101 to at least pivot down and, once the watercraft 200 enters the water, (may allow) flotation units 102 to at least begin to rise. Once cradle 101 is in its lowered position with watercraft 200 disengaged, watercraft lift 100 has transferred back as shown in FIG. 1, wherein watercraft lift 100 may float with the its forward, pivoting end lower to the waterline 300 than its rearward end.

Any or all of the components of the present invention, in any of its embodiments, may be made of or treated with any suitable material, including without limitation metal, alloys, stainless steel, plastics, carbon fiber materials, graphite and or materials that resist deterioration caused by weather, contact with water and or other dissimilar materials as it relates to electrolysis.

In view of the foregoing, it will be seen that the several advantages of the invention are attained, including its ability to operate in shallow water by being able to induce a pivotal end down floating bias, reducing the amount of pivot necessary to create sufficient clearance between the cradle and the bottom of a watercraft 200 to be lifted. This minimization of pivotal travel also reduces energy requirements, length of cable and length of cordage required. An additional feature of this present invention may now be evident in its ability to operate with permanently buoyant floatation, in contrast to the conventional devices that show inherent defects in design by relying on potentially leaky floatation chambers that must be filled with air and purged of water, and on the potentially leaky pumps, valves and plumbing required for filling and purging of the chamber, with the leakage causing potentially catastrophic lift failure. Still other features of this invention may now be evident, as in the ability to include a mechanism for locking its supporting cradle to this permanently buoyant floatation while in its raised position, decreasing lift failure associated with designs that rely solely on their lifting mechanisms to hold watercraft lifts in their raised positions.

Still other features of this present invention may now be evident in its flexibility of design to conform to watercraft of differing shapes and weights by at least interchanging, increasing and decreasing the buoyancy, size and number of the at least one buoyancy device 103, by moving and reorienting along buoyancy units 102, pivot points 105, winch drive mechanism 106, and battery unit 109 along watercraft's 100 longitudinal axis, thusly re-biasing and/or re-balancing watercraft lift 100. These buoyancy features may also provide stability at least sufficient to render secondary structures unnecessary. Additional features making this invention independent of secondary structures is its ability to provide self contained energy source and at least a drive mechanism. Furthermore, a drive mechanism may include at least a rechargeable power source like, but not limited to at least a battery, and at least a power source recharging system like but not limited to at least a solar recharging unit, and any combination of which may be mounted above the water, minimizing there exposure to the water and preventing there submersion. Additional features of this invention enable it to at least accommodate watercraft having deep drafts and keels, such as sailboats.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

We claim:

1. A mobile floating lift to enable raising, storing and lowering of a watercraft, comprising:

a cradle dimensioned and adjustable to conform to, engage, lift and store a watercraft, wherein the cradle has a first end and a second end opposite the first end;

at least two floatation assemblies each spaced along separate axes, each of the floatation assemblies having at least one floatation device, wherein the cradle is spaced between the at least two floatation assemblies pivotally attached near the first end of the cradle at at least one pivot point, and wherein a height of the at least two floatation assemblies, above the water, generally increases as the distance along the axis from the pivot point increases; and at least one drive mechanism operatively connected to at least one of the at least two floatation assemblies and to the cradle for moving the cradle in an arcing vertical direction toward the at least two floatation assemblies, wherein the at least one drive mechanism operates to raise and lower the second end of the cradle in an arc relative to the pivot point.

2. The mobile floating lift of claim 1, further comprising:

at least one structural support member dimensioned for providing structural member fastening points for attachment of at least the at least one floatation devices, the at least two floatation assemblies, a pivot, a drive mechanism and additional the structural support members.

3. The mobile floating lift of claim 1, wherein the at least one drive mechanism includes at least one of a mechanical device, a hydraulic device, a pneumatic device, a pulley purchase, and cordage for driving the cradle relative to the at least two floatation assemblies.

4. The mobile floating lift of claim 1, wherein the at least one floatation device is permanently buoyant.

5. The mobile floating lift of claim 1, further comprising:

a battery system that provides power to the at least one drive mechanism.

6. The mobile floating lift of claim 1, further comprising:

a locking mechanism that is operatively connected to at least one of the at least two floatation assemblies and to the cradle to prevent the cradle from moving in an arcing vertical direction relative to the at least two floatation assemblies, wherein the second end of the cradle is locked from making arcing movement relative to the pivot point.

7. The mobile floating lift of claim 1, further comprising:

at least one mooring device mounted to the mobile floating lift that operatively secures the lift to a watercraft and operatively maneuvers the watercraft to a position for engagement with the mobile floating lift.

8. The mobile floating lift of claim 1, wherein the cradle further comprises:

at least one vertical member piece extending substantially perpendicular to a longitudinal axis of the cradle for engagement with at least one member guide, wherein the at least one member guide is spaced on at least one floatation assembly.

9. The mobile floating lift of claim 1, wherein the cradle comprises at least one forward section and one rearward section and each forward and rearward cradle section having at least one forward end and at least one rearward end, wherein the rearward end of the at least one forward cradle section is hingedly attached to the forward end of the at least one rearward cradle section.

10. The mobile floating lift of claim 1, wherein the cradle comprises at least one forward section and one rearward section and each forward and rearward cradle section having at least one forward end and at least one rearward end, wherein the rearward end of the at least one forward cradle section is hingedly attached to the forward end of the at least one rearward cradle section.

11. A mobile floating lift to enable raising, storing and lowering of a watercraft, comprising:

a cradle dimensioned and adjustable to conform to, engage, lift and store a watercraft, wherein the cradle has a first end and a second end opposite the first end;

at least two floatation assemblies each spaced along separate axes, each of the at least two floatation assemblies having at least one floatation device, wherein the at least one floatation device is permanently buoyant, wherein at least one structural support member dimensioned for providing structural member fastening points for attachment of at least the at least one floatation devices, the at least two floatation assemblies, a pivot, a drive mechanism and additional the structural support members, wherein the cradle is spaced between the at least two floatation assemblies pivotally attached near the first end of the cradle at at least one pivot point, and wherein a height of the at least two floatation assemblies, above the water, generally increases as the distance along the axis from the pivot point increases; and at least one drive mechanism operatively connected to at least one of the at least two floatation assemblies and to the cradle for moving the cradle in an arcing vertical direction toward the at least two floatation assemblies, wherein the at least one drive mechanism operates to raise the second end of the cradle in an arc relative to the pivot point, wherein the at least one drive mechanism includes at least one of a winch, a ram cylinder, a worm gear, a pulley purchase, and cordage, for driving the cradle.

12. The mobile floating lift of claim 11, further comprising:

a battery system that provides power to the at least one drive mechanism.

13. The mobile floating lift of claim 11, further comprising:

a locking mechanism that is operatively connected to at least one of the at least two floatation assemblies and to the cradle to prevent the cradle from moving in an arcing vertical direction relative to the at least two floatation assemblies, wherein the second end of the cradle is locked from making arcing movement relative to the pivot point.

14. The mobile floating lift of claim 11, further comprising:

at least one mooring device mounted to the mobile floating lift that operatively secures the lift to a watercraft and operatively maneuvers the watercraft for a position of engagement with the mobile floating lift.

15. The mobile floating lift of claim 11, wherein the cradle further comprises:

at least one vertical member piece extending substantially perpendicular to a longitudinal axis of the cradle for engagement with at least one member guide, wherein the at least one member guide is spaced on at least one floatation assembly.

16. A mobile floating lift to enable raising, storing and lowering of a watercraft, comprising:

a cradle dimensioned and adjustable to conform to, engage, lift and store a watercraft, wherein the cradle has a first end and a second end opposite the first end, wherein the cradle includes at least one vertical member piece extending substantially perpendicular to a longitudinal axis of the cradle for engagement with at least one member guide, wherein the at least one member guide is spaced on at least one floatation assembly;

at least two floatation assemblies each spaced along separate axes, each of the at least two floatation assemblies having at least one floatation device, wherein the at least one floatation device is permanently buoyant, wherein at least one structural support member dimensioned for providing structural member fastening points for attachment of at least the at least one floatation device, the at least two floatation assemblies, a pivot, a drive mechanism and additional the structural support members, and wherein the cradle is spaced between the at least two floatation assemblies pivotally attached near the first end of the cradle at at least one pivot point, and wherein a height of the at least two floatation assemblies, above the water, generally increases as the distance along the axis from the pivot point increases; and at least one drive mechanism operatively connected to at least one of the at least two floatation assemblies and to the cradle for moving the cradle in an arcing vertical direction toward the at least two floatation assemblies, wherein the at least one drive mechanism operates to raise the second end of the cradle in an arc relative to the pivot point, wherein the at least one drive mechanism includes at least one of a winch, a ram cylinder, a worm gear, a pulley purchase, and cordage, for driving the cradle.

* * * * *